US006877433B1

(12) United States Patent
Stevenson

(10) Patent No.: US 6,877,433 B1
(45) Date of Patent: Apr. 12, 2005

(54) INCENDIARY

(75) Inventor: Robert Andrew Stevenson, Maylands (AU)

(73) Assignee: Raindance Systems Pty Ltd., Jandakot (AU)

( * ) Notice: Subject to any disclaimer, the term of this patent is extended or adjusted under 35 U.S.C. 154(b) by 0 days.

(21) Appl. No.: 10/607,970

(22) Filed: Jun. 30, 2003

(30) Foreign Application Priority Data

Jul. 1, 2002 (AU) ..... PS3289

(51) Int. Cl.[7] ..... F42B 10/00

(52) U.S. Cl. ..... 102/364; 102/334; 102/336; 102/365; 89/1.51

(58) Field of Search ..... 102/364, 365, 102/477, 334, 336; 244/136; 89/1.51

(56) References Cited

U.S. PATENT DOCUMENTS 3,638,573 A * 2/1972 Campbell ..... 102/364
3,951,067 A * 4/1976 Schroeder ..... 102/364
4,860,657 A * 8/1989 Steinicke et al. ..... 102/334
H1047 H * 5/1992 Henderson et al. ..... 102/496
H1048 H * 5/1992 Wilson et al. ..... 102/364
5,117,759 A * 6/1992 Henderson et al. ..... 102/496
5,168,123 A * 12/1992 Lee ..... 102/365
5,535,679 A * 7/1996 Craddock ..... 102/494

FOREIGN PATENT DOCUMENTS

FR 2645635 * 10/1990 ..... 102/364

* cited by examiner

*Primary Examiner*—Harvey E. Behrend
(74) *Attorney, Agent, or Firm*—Neifeld IP Law, PC

(57) ABSTRACT

An incendiary 10 includes a plurality of containers 12 each containing a volume of a first substance such as potassium permanganate which, when mixed with a second substance such as glycol which is injected at a later time, reacts exothermically to generate a flame. Frangible couplings in the form of tabs 16 couple or connect adjacent containers 12 together. Thus the incendiary 10 is in the form of a flexible belt having a plurality of containers 12 which are mutually held together until separated by a dispensing/initiating machine. Each container 12 includes a flat surface 22 and a receptacle 18 having an opening 20 which opens onto the flat surface 22. A seal 24 extends across and closes the opening 20.

10 Claims, 2 Drawing Sheets

INCENDIARY

FIELD OF THE INVENTION

The present invention is an incendiary particularly, although not exclusively, for use in airborne fire control procedures such as back burning.

BACKGROUND OF THE INVENTION

It is known to drop incendiaries from aircraft such as helicopters and light fixed wing aircraft for the purposes of forestry management and back burning. One known incendiary is in the form of a small sphere (of approximately 32 mm diameter) of plastics material filled with a quantity of potassium permanganate granules or powder. The sphere is injection moulded from extruded plastic. A small hole is formed in the sphere to allow filling with a volume of potassium permanganate. The hole is then sealed with wax or glue. These spheres are typically dropped from dispensers mounted in aircraft. The dispensers are provided with a hopper for holding a large number of spheres and feeding the spheres sequentially to a chute where they are injected with a small volume of glycol. The potassium permanganate and glycol react exothermically leading to the generation of a flame.

Ideally, the flame is produced about 20–30 seconds after injection of the glycol by which time the spheres have been ejected from the dispenser and reached the ground.

While this form incendiary has performed adequately, it does suffer from several problems. Because of their shape the spherical incendiaries are inherently difficult to store and, if they spill from the hopper roll to various parts of the aircraft leading to potential safety hazards. Further, the spheres have a surprisingly low reliability in the order of 80%. This is in part due to difficulties in sequentially feeding the spheres to a chute and then successfully injecting them with glycol. It is not uncommon for the spheres to become jammed in the chute which then requires manual clearing. If the clearing is not performed expeditiously, there is a risk of combustion occurring within the chute itself. Consequently it is a requirement that this type of incendiary be attended to on a full time basis during dispensing. Another reason for their relatively low reliability is that if a sphere is orientated so that the needle injecting the glycol is aligned with the previously described wax or glue seal, the needle can become blocked preventing the injection of glycol and thus halting the operation of the dispenser. To recommence the injecting and dispensing process the blocked needle has to be removed, cleaned and reinstalled.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

OBJECT OF THE INVENTION

It is an object of the present invention to provide an alternate form of incendiary device which attempts to alleviate the problems inherent in the use of the known sphere type devices.

SUMMARY OF THE INVENTION

According to the present invention there is provided an incendiary comprising:

a plurality of containers, each container containing a volume of a first substance, which, when mixed with a second substance, reacts exothermically; and, one or more frangible couplings which couple said plurality of containers together.

Preferably said frangible couplings couple said containers side-by-side.

Preferably said frangible couplings couple said containers serially in a line.

Preferably said frangible couplings flexibly couple said containers together to form a flexible belt of containers.

Preferably said frangible couplings are flexible.

Preferably each container is provided with a substantially flat surface.

Preferably each container comprises a receptacle which opens onto said flat surface.

Preferably each container further comprises a seal which extends across said flat surface to close said container.

In one embodiment said seal is in the form of a strip of material which seals adjacent containers and couples said adjacent containers together to thereby act as said one or more frangible couplings.

In another form of the invention each frangible coupling is in the form of a tab connected on opposite sides to respective adjacent containers. In this form preferably said frangible couplings are formed integrally with said containers. Moreover it is considered convenient that said frangible couplings are formed integrally with said flat surfaces.

BRIEF DESCRIPTION OF THE DRAWINGS

Embodiments of the present invention will now be described by way of example only with reference to the accompanying drawings in which.

DETAILED DESCRIPTION OF PREFERRED EMBODIMENTS

Figure 1:
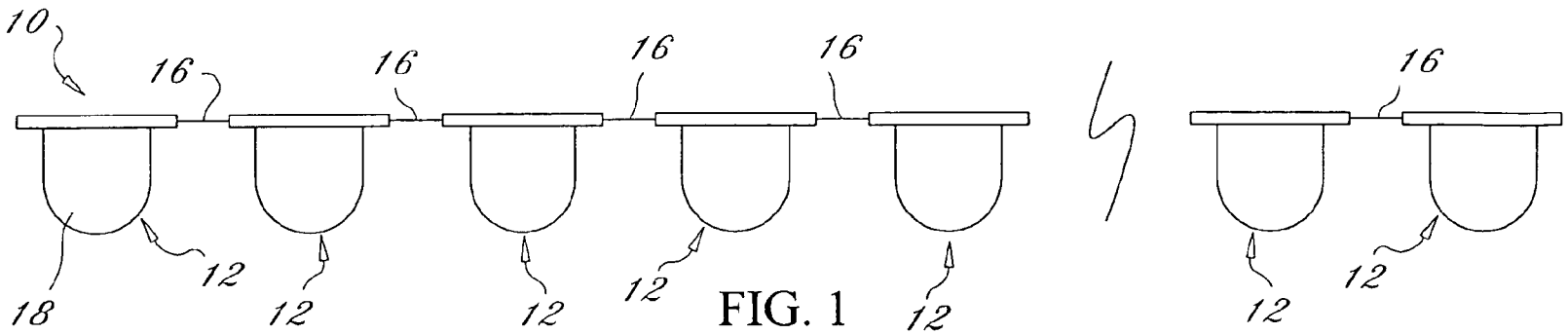
FIG. 1 is a schematic representation from the side of an incendiary in accordance with the present invention.
Figure 2:
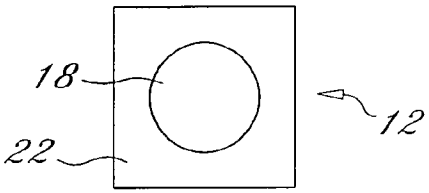
FIG. 2 is a bottom view of one of the containers in the incendiary shown in FIG. 1.
Figure 3:
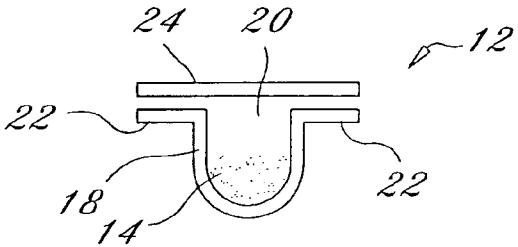
FIG. 3 is a section view through the container shown in FIG. 2.

Referring to the accompanying drawings, and in particular FIGS. 1–3, it can be seen that an incendiary 10 in accordance with an embodiment of the invention includes a plurality of containers 12 each containing a volume of a first substance 14, for example potassium permanganate, which, when mixed with a second substance, for example glycol (not shown) reacts exothermically. The exothermic reaction continues to the extent that the substances combust and generate a flame. A frangible coupling in the form of one or more tabs 16 couples or connects the containers 12 together. Most conveniently, the tabs 16 couple the containers 12 side-by-side, and more particularly serially in a line. In this way, the incendiary 10 is in the form of a flexible belt having a plurality of containers 12 which are mutually held together until separated by a dispensing/initiating machine (not shown).

In the embodiment depicted in FIGS. 1–3, each container 12 includes a receptacle 18 in the shape of a hemisphere having an opening 20 which opens into a flat surface 22. The opening 20, and flat surface 22 lie in a plane containing the diameter of the hemispherical receptacle 18, with the flat surface 22 extending outwardly from the perimeter of the opening 20.

During manufacture, the receptacle 18 is initially formed and then a volume of the material 14 deposited therein. Thereafter, the opening 20 is closed by a seal 24 which extends across the flat surface 22. The seal 24 can be in the form of a thin metal foil, a plastics sheet or a paper or cardboard strip which is glued or otherwise attached to the receptacle 18 and/or flat surface 22.

When the incendiary 10 is in use, typically, a needle will be used to pierce through the seal 24 to inject a volume of glycol into the receptacle portion 18.

The tab 16 which constitutes the frangible coupling can take many different forms. In FIG. 1, the tab 16 is illustrated as a thin web of material extending between the flat surfaces 22 of adjacent containers 12. The web may be formed separately of the containers 12 and individually attached between adjacent containers 12. However this is likely to be an inefficient way of forming the coupling. Other forms of couplings are depicted in FIGS. 4 and 5.

Figure 4:
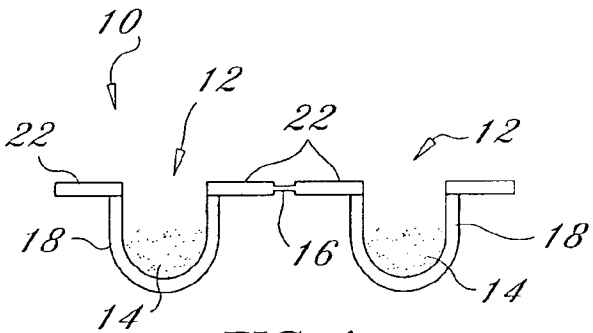
FIG. 4 is a schematic representation of the incendiary depicting one form of frangible coupling between adjacent containers.

In FIG. 4, the coupling 16 is formed integrally with the flat surfaces 22 of adjacent containers 12, as a section of a reduced thickness for ease of separation and to provide additional flexibility between adjacent containers 12.

Figure 5:
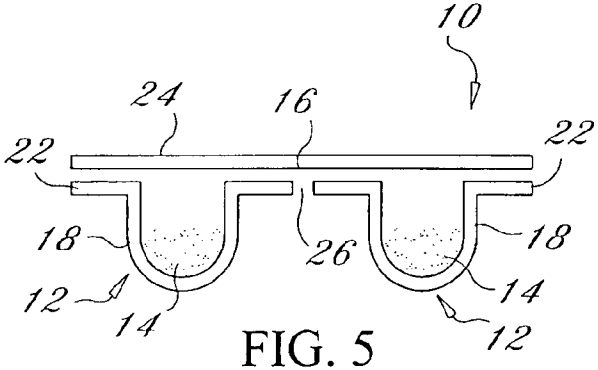
FIG. 5 is a schematic representation of the incendiary depicting another form of frangible coupling between adjacent containers.

In FIG. 5, the frangible coupling 16 is formed as an integral part of the seal 24 which spans a small separation gap 26 between adjacent containers 12. To further facilitate separation of adjacent containers 12 the frangible couplings 16 may be provided with a line of perforations or slits (not shown).

In yet a further alternative frangible coupling 16 can be formed as a strip of frangible material such as metal or plastic or paper which runs along and is attached to the surfaces 22 of adjacent containers 12 overlying the seal 24, to span separation gaps 26 between adjacent containers 12.

Figure 6:
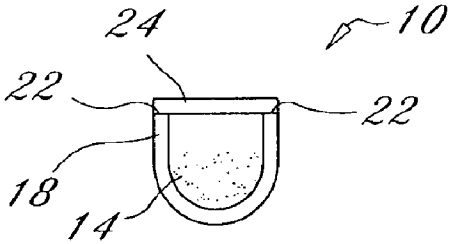
FIG. 6 is a section view of a container of a further embodiment of the incendiary.

In the embodiments depicted in FIGS. 1–5, the flat surface 22 extends outwardly in a plane containing the diameter of the hemispherical receptacles 18. However, in a further embodiment depicted in FIG. 6, the flat surfaces 22 can be limited to the upper surface of the receptacle portion 18 surrounding the opening 20. Accordingly the surface 22 would in effect be in the shape of an annulus. The seal 24 is glued or otherwise attached to the surface 22 as in the previous embodiments. Adjacent containers 12 of the type depicted in FIG. 6 can be coupled together with a frangible coupling means in a similar manner as described above in relation to the incendiary 10 depicted in FIGS. 1–5.

Figure 7:
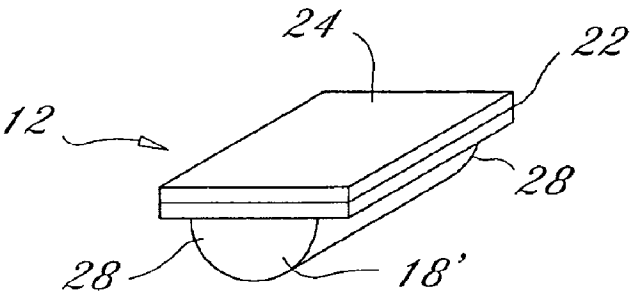
FIG. 7 is a perspective view from the side of a container of another embodiment of the incendiary.
Figure 8:
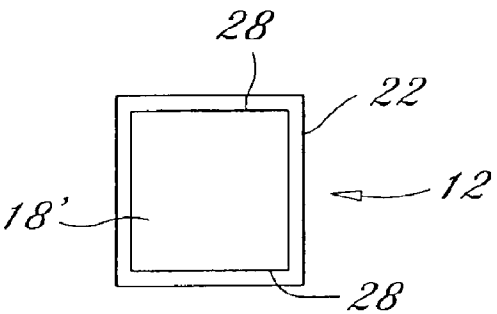
FIG. 8 is a bottom view of the container depicted in FIG. 4.

FIGS. 7 and 8 depict a further variation in the configuration of the container 12. In this embodiment, the receptacle portion 18' is in the shape of a hemicylinder, ie a cylinder cut in a plane containing its central longitudinal axis, and having its opposite ends closed with semicircular walls 28. The receptacle 18' opens onto a flat surface 22 which extends outwardly from the perimeter of the opening. The container 12 is sealed with a seal 24, and coupled to adjacent containers 12 in a similar manner as described above in relation to the embodiments depicted in FIGS. 1–6.

Now that several embodiments of the present invention have been described in detail, it will be apparent to those skilled in the relevant arts that numerous modifications and variations may be made without departing from the invention in its broadest form. In particular, the shape of the receptacle 12 is essentially limitless. It can, for example, take the form of a cube, triangular prism or indeed even a sphere. Also, fins or other aerodynamic aids may be provided, for example by moulding integrally with the containers 12, to improve the aerodynamics of the incendiary 10. It will also be evident that many forms of coupling 16 can be used provided the coupling can be broken, either by hand or by machine, when the incendiary 10 is in use to allow separation of previously coupled incendiaries. For example with particular reference to FIG. 4 the coupling 16 could be a simple extension of a part of the surfaces 22 of adjacent containers 12 without the need for an intermediate zone of reduced thickness. In this form the coupling 16 can be broken by a mechanical cutter (e.g. a blade or guillotine) in a dispensing machine (not shown). Alternately or in addition a score line can be formed along the surface 22 of adjacent containers or a notch cut in an edge at an intermediate point between surfaces 22 of adjacent container 12 to assist in the manual or mechanical separation of the containers 18.

Figure 9:
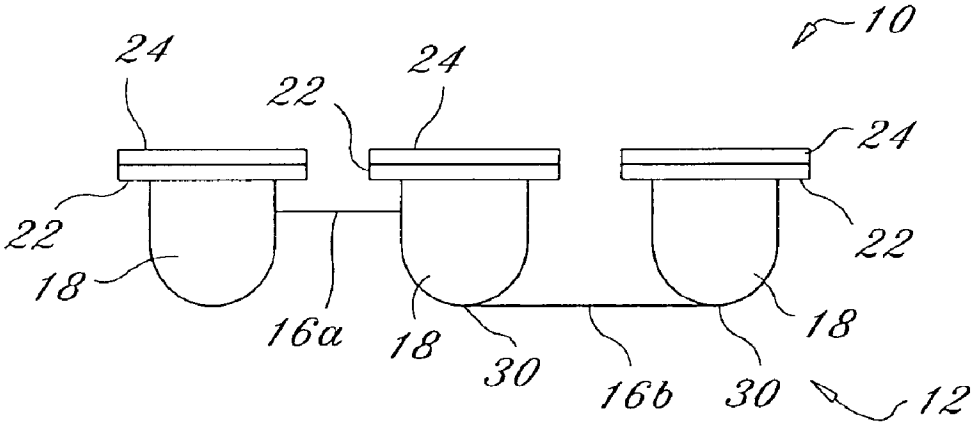
FIG. 9 is a side view of another embodiment of the incendiary.

In yet a further variation, it is possible to form the couplings 16 between the outer surfaces of the receptacles 18 rather than between the surfaces 22. FIG. 9 depicts two such variations where coupling 16*a* is attached to two adjacent containers 18 at respective points between the flat surfaces 22 and the apex 30 of two adjacent containers 12; and a coupling 16*b* extends between the apexes 30 of adjacent containers 12. The couplings 16*a*, 16*b* can be in the form of one or more strands or webs. It is envisaged that the embodiments depicted in FIG. 9 may not be the most convenient embodiments of the invention but nevertheless serve to illustrate that the couplings 16 need not be limited to extending between or lying in the plane of the surfaces 22.

All such modifications and variations together with others that would be obvious to a person of ordinary skill in the art are deemed to be within the scope of the present invention the nature of which is to be determined from the above description, and the appended claims.

The claims defining the invention are as follows:

1. A flexible belt incendiary feedstock for an incendiary dispensing machine, said flexible belt incendiary feedstock comprising:

a plurality of containers, each container containing a volume of a first substance, which, when mixed with a second substance injected by said incendiary dispensing machine, reacts exothermically; and, respective flexible frangible couplings which couple said plurality of containers together.

2. The incendiary feedstock according to claim 1 wherein said frangible couplings couple said containers side-by-side.

3. The incendiary feedstock according to claim 1 wherein said frangible couplings couple said containers serially in a line.

4. The incendiary feedstock according to claim 1 wherein each container is provided with a substantially flat surface.

5. The incendiary feedstock according to claim 4 wherein each container comprises a receptacle which opens onto said flat surface.

6. The incendiary feedstock according to claim 5 wherein each container further comprises a seal which extends across said flat surface to close said container.

7. The incendiary feedstock according to claim 6 wherein said seal is in the form of a strip of material which seals adjacent containers and couples said adjacent containers together to thereby act as said frangible couplings.

8. The incendiary feedstock according to claim 1 wherein each frangible coupling is in the form of a tab connected on opposite sides to respective adjacent containers.

9. The incendiary feedstock according to claim 1 wherein said frangible couplings are formed integrally with said containers.

10. The incendiary feedstock according to claim 5 wherein said frangible couplings are formed integrally with said flat surfaces.

* * * * *